United States Patent [19]

Waring, III et al.

[11] Patent Number: 4,792,085

[45] Date of Patent: Dec. 20, 1988

[54] BUCKLE-PROOF CLAMSHELL CONTAINER

[76] Inventors: John S. Waring, III, 1708 Winding Ridge Dr., Richmond, Va. 23233; Gary E. Pluff, 2701 Forbes Dr., Prince George, Va. 23875

[21] Appl. No.: 1,797

[22] Filed: Jan. 9, 1987

[51] Int. Cl.[4] ..... B65D 5/42

[52] U.S. Cl. ..... 229/114; 229/146; 229/902; 229/920; 229/DIG. 4

[58] Field of Search ..... 229/112–114, 229/145, 146, 148–150, 902, 906, 920, 16 R, DIG. 4; 220/339, 4 B, 4 E

[56] References Cited

U.S. PATENT DOCUMENTS

| | | | |
|---|---|---|---|
| 1,839,752 | 1/1932 | Fogg | 206/44 R |
| 2,157,686 | 5/1939 | Ballard | 229/DIG. 4 |
| 3,019,958 | 2/1962 | Asman et al. | 229/31 |
| 3,043,354 | 7/1962 | Fitzgerald | 150/5 |
| 3,228,710 | 1/1966 | Chodorowski | 229/920 |
| 3,512,698 | 5/1970 | Kapustka | 229/44 |
| 3,799,032 | 3/1974 | Jeronimus | 206/44 |
| 3,813,027 | 5/1974 | Misdom, Jr. et al. | 229/45 |
| 4,132,344 | 1/1979 | Jewell | 229/2.5 R |
| 4,232,816 | 11/1980 | Johnson et al. | 229/114 |
| 4,266,713 | 5/1981 | Maroszek | 229/114 |
| 4,273,249 | 6/1981 | Florian | 220/4 |
| 4,360,147 | 11/1982 | Brauner | 229/33 |
| 4,498,589 | 2/1985 | Scott et al. | 206/526 |

*Primary Examiner*—Stephen Marcus
*Assistant Examiner*—Gary E. Elkins

[57] ABSTRACT

Disclosed are various diagonal incisions adjacent the hinge line of a clamshell container. These diagonal incisions allow opening of the clamshell container without permanent buckling. Also disclosed are ribs formed above, below, and parallel to, the hinge line of a clamshell container.

19 Claims, 3 Drawing Sheets

BUCKLE-PROOF CLAMSHELL CONTAINER

FIELD OF THE INVENTION

This invention relates to clamshell containers. More particularly, the invention relates to containers, generally made of paperboard or boxboard for household products, especially food products such as hamburgers, wherein the containers are designed to open, in a clamshell-like fashion, to expose the products for access and, in the case of foods, for subsequent consumption.

BACKGROUND OF THE INVENTION

The prior art is replete with containers, especially clamshell-type containers which are often used in a fast-food environment to package hamburgers, chicken, pizza, or the like. Particularly when these containers are made from thinner grades of paperboard, opening them sometimes becomes difficult because, depending upon the dimensions of the container, the paperboard containers develop sufficient resistance to opening to create a back region which buckles. This buckling typically occurs around the center region of the back panel of the clamshell container, both above and below the hinge line which characterizes these containers. It is necessary (and awkward) for the consumer to press his hand or fingers in the region that has buckled to obtain proper opening of the package.

For this reason, the prior att has shown various ways to deal with this "buckling" problem. Typical of these is U.S. Pat. No. 4,232,816, which discloses a clamshell-type carton which on the back panel thereof and perpendicular to the hinge line, has formed . thereon adjacent slits which are normal to, and bisect, a hinge line. Such slits are intended to offer sufficient stress relief so that the back wall of the clamshell carton does not permanently buckle when opened.

Despite these efforts of the prior art, it has still not been a satisfactory state of affairs because "buckling" still occurs, especially in paperboard clamshell containers, particularly when thinner grades of paperboard are used.

Accordingly, it is a primary object of this invention to provide a novel type of stress relief in a paperboard clamshell container to assure a buckle free opening along the hinge line thereof.

SUMMARY OF THE INVENTION

According to the invention, diagonal incisions, not normal to the hinge line of the clamshell container, are inserted both above and below the hinge line, generally in the central region of the back panel along the hinge line as it extends from side-to-side. These incisions, of which there may be several, have proven to virtually eliminate buckling regardless of the grade of paperboard used, and regardless of the dimensions involve,, i.e. a very high back panel or a very long back panel.

In addition to the incisions above described, clamshell containers made in accordance with the invention also may employ two ribs embossed in the back panel of such container, above and below, and parallel to, the hinge line.

DETAILED DESCRIPTION OF THE INVENTION

Figure 1:
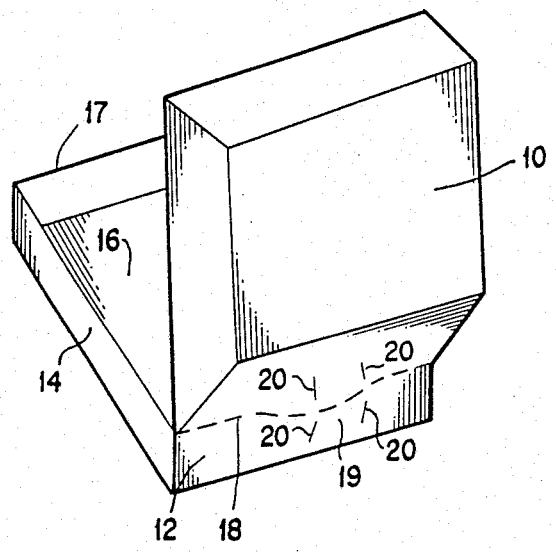
FIG. 1 PRIOR ART
FIG. 1 is a perspective view of a typical clamshell type container of the prior art.

Reference is first made to FIG. 1 for the general details of a typical clamshell-type container of the prior art. There is shown a container having a bottom 16, with a top 10. Lateral sides 14, front side 17, and a back panel 12, comprise the essential details of a typical clamshell container. Along the back panel 12 of the container, there is impressed a weakened hinge line 18 around which a top 10 can be pivoted to open the container so that it is ready to expose its contents. Depending upon the dimensions of the container, and on the type of paper used, it is inevitable that some degree of buckling will occur in the central region 19 of the back panel 12, despite the presence of slits 20 which have been incised normal to the hinge line 18.

Figure 2:
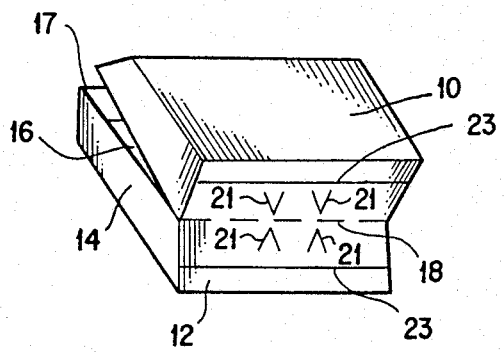
FIG. 2 is a back panel perspective view of a new and improved clamshell container according to the invention.

FIG. 2 shows an improved clamshell container according to the invention. All parts having similar functions to the clamshell container shown in FIG. 1, are numbered with identical numbers. Unlike the prior art, however, the improved clamshell container according to the invention has diagonal "V" like slits 21 formed into the back panel, both above and below the hinge line 18. The tips of the "V" like slits are illustrated as approaching, but not touching, the hinge line 18. In practice however, the tips of the "V" may touch the hinge line 18. These incisions sufficiently weaken the central region of back panel 12 so as to relieve any buckling when the clamshell container is opened by pivoting the top 10 about the hinge line 18. In practice, it has been found expeditious to dispose the incisions 21 generally in the vicinity of the midpoint (i.e. central region) of the hinge line 18 as it runs from one side of the container to the other.

Also shown in FIG. 2 are ribs 23 embossed on the back panel 12, both above and below the hinge line 1B and extending parallel thereto. Ribs 23 may be advantageously utilized, in addition to the incisions 21, to promote a buckle-free opening, although containers without ribs 23 will function satisfactorily with only incisions 21 formed above and below the hinge line. As will be further explained hereinbelow, ribs 23 cooperate with incisions 21 to reduce the required length of the latter.

Figure 3:
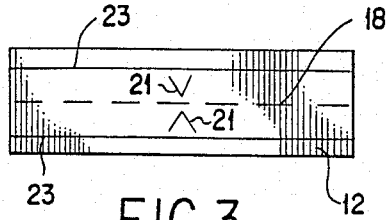
FIGS. 3 through 8 are views of the back panel of the improved clamshell container according to the invention showing other types of incisions to assure a buckle-free opening.

With reference to FIG. 3, there is disclosed an alternative version of incisions made above and below the hinge line 18. Instead of having dual incisions 21 above and below the hinge 18 (as shown in FIG. 2), the version disclosed in FIG. 3 shows only a single incision above and below hinge line 18, said incision 21 being placed generally at the midpoint of hinge line 18 as it extends from on side of the clamshell container to the other.

Figure 4:
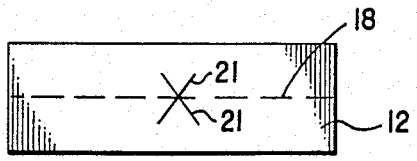

With reference to FIG. 4, there is shown again a back view of yet another way of forming the incisions 21 on the back panel 12 of an improved clamshell container according to the invention. Instead of appearing "V"-like, as in FIGS. 2 and 3, the incision shown in FIG. 4 is "X"-like, and is generally located in the midpoint of the hinge line 18 as it extends from one side of the carton to the other.

Figure 5:
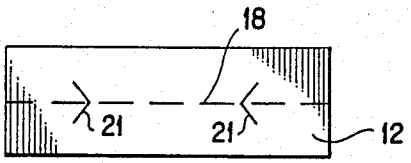
Figure 6:
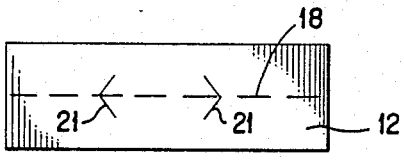

With reference to FIGS. 5 and 6, there are shown yet further types of incisions on the back panel 12 of an improved clamshell container according to the invention. Instead of being vertically oriented, the "V"-like incisions 21 in both FIGS. 5 and 6 are horizontally oriented, in FIG. 5 with the tips of the "V" running toward the center of the back panel 12 of the container, while in FIG. 6 the tips of the "V" are oriented toward the sides of the container.

Figure 7:
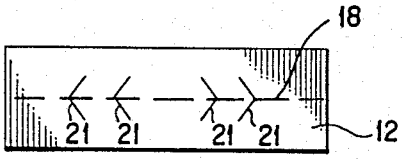
Figure 8:
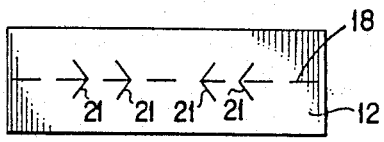

FIGS. 7 and 8 show further variations on the incisions shown in FIGS. 5 and 6 in that a plurality of "V"-like incisions 21 are formed in the back panel 12, both above and below the hinge line 18.

As shown in FIGS. 5 through B, the "V"-like incisions 21 may not be located exactly at the center of the hinge line 18 as it extends from one side of the container to the other, but need only be located generally in a central region.

Figure 12:
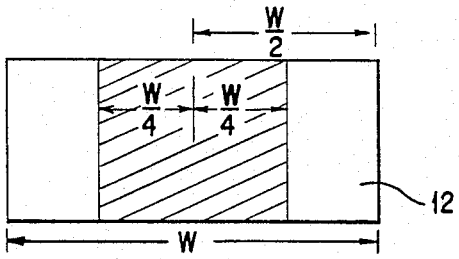
FIG. 12 shows the central region of the back panel of the clamshell container wherein the incisions are most advantageously placed.

It has been found that with the most commonly used grade of paperboard used in packaging for hamburgers or the like, the central region embraces a region the distance of which from the midpoint extends to either side of the midpoint approximately one half of the distance between the midpoint and the side of the containers. This is best illustrated in FIG. 12 in which the central region is shown in the shaded portion extending a distance of W/4 to either side of the midpoint, where W is the width of the carton.

Figure 9:
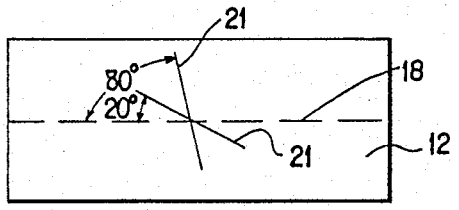
FIG. 9 shows a view illustrating both the minimum and maximum angles of the diagonal incision on the back panel of the improved clamshell container according to the invention.

With reference to FIG. 9, there is shown the inclination, in degrees, from the horizontal of the diagonal incisions 21 which have been found to be most advantageous for use in the invention. It has been determined that tee minimum angle from the horizontal of a diagonal incision 21 should not be less than 20°, and the maximum angle not more than 80° in order for the diagonal incisions 21 to most effectively perform their intended purpose without undesirable side effects. It has been found that the most preferable angle is 45°. It is believed, however, that the above range can be extended to a minimum angle of about 5° and a maximum angle of about 85°.

Figure 10:
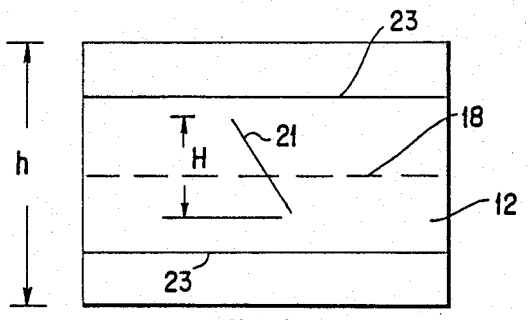
FIG. 10 shows a view illustrating the minimum vertical height of the diagonal incisions on the back panel of the improved clamshell container according to the invention.

With reference to FIG. 10, the minimum, vertical height "H" of a diagonal incision 21, as compared with the height "h" of the back panel 12 of the clamshell container according to the invention is illustrated. It has been found that with the presence of the horizontal ribs 23, also embossed on the back panel 12, "H" can be as small as 15% of "h". When ribs 23 are not used, it is believed that the dimension "H" should preferably be increased.

Figure 11:
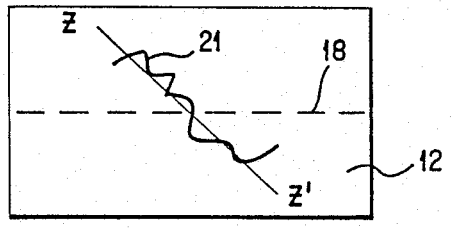
FIG. 11 shows a modified incision within the scope of the invention.

While the previous embodiments of the invention have all been described in terms of a "diagonal" incision, i.e. a straight line, the invention is not so limited. Reference to FIG. 11 will show that non-straight line incision 21, shaped in such a fashion that the thrust line Z–Z′ thereof is at a diagonal to hinge line 18, serves the purposes of the invention. Accordingly, the use of the word "diagonal", both in the specification and claims herein, shall be constructed to include non-straight line incisions of the type shown as incision 21 in FIG. 11.

Although the invention has been described above by reference to preferred embodiments thereof, it will be appreciated that the foregoing and other changes may be made without departing from the scope and spirit of the invention as defined by the claims appended hereto.

What is claimed is:

1. In a clamshell type container having a top portion, a bottom portion, two side portions and a back panel portion separating said top portion from said bottom portion along a single hinge line having a midpoint halfway between said two side portions, said back panel portion having a central region which extends from the midpoint of said single hinge line about one-half of the distance from said midpoint to said side portion, the improvement comprising:

intersecting, non-coextensive diagonal incisions formed in said back panel in said central region, both above and below, and for less than the entire length of, said hinge line, said diagonal incisions being so formed that any two thereof will touch one another at a point that lies approximately on said single hinge line, whereby permanent buckling of the back panel is avoided when said top portion is pivoted about said hinge line to open said container.

2. An article according to claim 1, wherein said diagonal incisions are placed at the midpoint of the hinge line as it extends from one side of the container to the other.

3. An article according to claim 1, wherein said diagonal incisions form the shape of a single "X".

4. An article according to claim 1, wherein said diagonal incisions form the shape of two "V"s, with each "V" having a tip.

5. An article according to claim 1, wherein said diagonal incisions form the shape of a plurality of "V"s.

6. An article according to claim 5, wherein said tips of said "V"s are oriented towards said midpoint of said back panel portion of said container.

7. An article according to claim 6, wherein said tips of said "V"s are oriented towards said midpoint of said back panel portion of said container.

8. An article according to claim 5, wherein said tips of said "V"s are oriented away from said midpoint of said back panel portion of said container.

9. An article according to claim 6, wherein said tips of said "V"s are oriented away from said midpoint of said back panel portion of said container.

10. An article according to claim 1, wherein the angle between said diagonal incisions and said hinge line is not less than 20°.

11. An article according to claim 1, wherein the angle between said diagonal incisions and said hinge line is not more than 80°.

12. An article according to claim 1, further including ribs formed on said back portion, said ribs being formed both above and below, and parallel to, said hinge line.

13. An article according to claim 12, wherein the vertical extent of said diagonal incisions is no less than 15% of the total height of said back portion.

14. An article according to claim 1, wherein said diagonal incisions are placed at the midpoint of the hinge line as it extends from one side of the container to the other.

15. An article according to claim 14, wherein said diagonal incisions form the shape of a single "X".

16. An article according to claim 14 wherein said diagonal incisions form the shape of two "V"s.

17. An article according to claim 14, wherein said diagonal incisions form the shape of a plurality of "V"s.

18. An article according to claim 1, wherein the angle between said diagonal incisions and said hinge line is not less than 5°.

19. An article according to claim 1, wherein the angle between said diagonal incisions and said hinge line is not ore than 85°.

* * * * *